US008398376B2

(12) United States Patent
Hope

(10) Patent No.: US 8,398,376 B2
(45) Date of Patent: Mar. 19, 2013

(54) DRY PUMPS

(75) Inventor: Mark Christopher Hope, Croydon (GB)

(73) Assignee: Edwards Limited, Crawley, West Sussex (GB)

( * ) Notice: Subject to any disclaimer, the term of this patent is extended or adjusted under 35 U.S.C. 154(b) by 2304 days.

(21) Appl. No.: 10/532,275

(22) PCT Filed: Sep. 24, 2003

(86) PCT No.: PCT/GB03/04091

§ 371 (c)(1),
(2), (4) Date: Sep. 28, 2005

(87) PCT Pub. No.: WO2004/038222

PCT Pub. Date: May 6, 2004

(65) Prior Publication Data

US 2006/0099083 A1 May 11, 2006

(30) Foreign Application Priority Data

Oct. 24, 2002 (GB) ..... 0224709.6

(51) Int. Cl.
*F04B 49/00* (2006.01)

(52) U.S. Cl. ..... 417/12; 417/14; 417/18; 417/32; 417/53

(58) Field of Classification Search ..... 417/12, 417/14, 18, 32, 53; 118/50, 715–733; 156/345.29, 156/345.1–345.54
See application file for complete search history.

(56) References Cited

U.S. PATENT DOCUMENTS 5,443,644 A 8/1995 Ozawa
5,713,724 A 2/1998 Centers et al.
5,961,291 A * 10/1999 Sakagami et al. ..... 417/42
6,116,032 A 9/2000 Mori et al.
6,274,507 B1 8/2001 Narita et al.
7,314,039 B2 * 1/2008 Toniato ..... 123/497
2006/0198735 A1 * 9/2006 Iijima et al. ..... 417/44.1

FOREIGN PATENT DOCUMENTS

EP 0 476 631 A1 3/1992
EP 0 594 461 A1 4/1994
EP 1 120 814 A2 8/2001

OTHER PUBLICATIONS

Patent Abstracts of Japan, vol. 2002, No. 04, Aug. 4, 2002; abstract of JP 2001 342950 A, Norihiko Nomura, "Vacuum Dry Pump and Trapping Method," (Ebara Corp.), Dec. 14, 2001.
United Kingdom Search Report for Application No. GB 0224709.6; Date of Search: Apr. 24, 2003.
PCT International Search Report of International Application No. PCT/GB2003/004091; Date of mailing Dec. 17, 2003.

* cited by examiner

*Primary Examiner* — Charles Freay
*Assistant Examiner* — Christopher Bobish

(57) ABSTRACT

A dry pump apparatus comprises; a pumping mechanism, a controller for controlling the operation of the pumping mechanism, and a sensor for sensing the operating temperature of the pumping mechanism. The controller is configured to carry out an automated shutdown sequence involving the following steps; a) ceasing operation of the pumping mechanism b) monitoring the temperature of the pumping mechanism by means of the temperature sensor c) at least one pre-selected temperature interval, initiating operation of the pumping mechanism for a fixed time period so as to purge a proportion of contaminant particulate matter present until a predefined temperature is reached or a predefined time limit has passed. By carrying out these steps the incidence of powder compaction between component parts of the apparatus which may contract during shutdown, and consequential restart failure and down time, can be significantly reduced.

20 Claims, 6 Drawing Sheets

DRY PUMPS

CROSS REFERENCE TO RELATED APPLICATIONS

This application claims the benefit of International Patent Application Number PCT/GB2003/004091, filed Sep. 24, 2003, which claims priority to Great Britain Patent Application No. 0224709.6, filed Oct. 24, 2002.

BACKGROUND OF THE INVENTION

This invention relates to dry pumps and in particular to the clearing of particulate dirt from dry pumps.

Dry pumps typically comprise non-contacting, self-valving mechanisms and no oil or lubricants in the pumping mechanism. The component parts of these pumps are manufactured to tight tolerances to provide fixed running clearances between components and reduce friction or other reactive forces, which may reduce the efficiency of the pump mechanism. The pumps are used in many manufacturing applications, one of the major of which is semi-conductor manufacture. The pumps are used to provide the very clean, near vacuum environment needed for the manufacture of quality semi-conductor products. The skilled addressee will no doubt be familiar with other common applications of dry pump technology.

Many industries including the semi-conductor industry produce particulate or powderous waste or bi-products which are withdrawn from the manufacturing environment by pumps such as the dry pumps to which this invention relates. In the semi-conductor industry it is usual for manufacturing lines to run twenty four hours a day, thus, dry pumps used in this application are in continuous use except where there is a need for a manufacturing line change or maintenance or repair of the pump. The pumps have an inlet purge function on shut down for evacuating contaminants from the pump mechanism, but these purge functions rarely operate one hundred percent efficiently and some level of particulate contamination invariably remains within the pump.

Running temperatures for dry pumps in semi-conductor manufacturing lines are typically around 120° C., when the pumps are switched off, they cool to normal room temperature (around 19° C.), the components (such as rotors and stators in the pump mechanism) contract, reducing the running clearances between them and any particulate contaminants present in the mechanism are compacted in between the contracted components. On restart, where the torque required to overcome the friction caused by the presence of these particulate materials compacted between the components is higher than the operational torque of the pump, start-up failure occurs.

The present invention aims to maintain running clearances of dry pumps and minimise the occurrence of restart failure due to compacted particulate contaminants.

BRIEF SUMMARY OF THE INVENTION

In accordance with a first aspect, the present invention provides a dry pump apparatus comprising;

a pumping mechanism, a controller for controlling the operation of the pumping mechanism, and a sensor for sensing the operating temperature of the pumping mechanism wherein the controller is configured to carry out an automated shutdown sequence involving the following steps;

a) ceasing operation of the pumping mechanism b) monitoring the temperature of the pumping mechanism by means of the temperature sensor c) at at least one pre-selected temperature interval, initiating operation of the pumping mechanism for a fixed time period so as to purge a proportion of contaminant particulate matter present until a predefined temperature is reached or a predefined time limit has passed.

This pulsed purging method effected by the controller of the dry pump apparatus enables small amounts of contaminant to be evacuated from the pump as it cools so that when the apparatus is cooled to the ambient temperature, there is significantly less particulate contaminant in the pumping mechanism than there would otherwise be. Thus, the particulate material is less compact and frictional forces to be over come on start-up, significantly less. Consequently, the occurrence of failure on restart is significantly reduced.

It will be understood that this pulsed shut down method is what provides the technical improvement in the function of prior art dry pumps. Accordingly, in a second aspect, the invention provides a method for reducing the incidence of restart failure in a dry pump comprising the steps of;

a) detecting the cessation of operation of the pumping mechanism b) monitoring the temperature of the pumping mechanism after cessation of operation c) at at least one pre-selected temperature interval, initiating operation of the pumping mechanism for a fixed time period so as to purge a proportion of contaminant particulate matter present until a predefined temperature is reached or a predefined time limit has passed.

The controller of the dry pump apparatus may comprise a microprocessor which may be embodied in a computer, which in turn is optionally programmed by computer software which, when installed on the computer, causes it to perform the method steps a) to c) mentioned above.

In a third aspect therefore the invention comprises a program for a computer which, when installed on the computer, causes it to perform the method steps of;

a) detecting the cessation of operation of the pumping mechanism b) monitoring the temperature of the pumping mechanism after cessation of operation c) at at least one pre-selected temperature interval, initiating operation of the dry pump for a fixed time period so as to purge a proportion of contaminant particulate matter present until a predefined temperature is reached or a predefined time limit has passed.

In a fourth aspect, the invention comprises a computer readable carrier medium which carries a computer program which when installed on a computer, causes it to perform the method steps of;

a) detecting the cessation of operation of the pumping mechanism b) monitoring the temperature of the pumping mechanism after cessation of operation c) at at least one pre-selected temperature interval, initiating operation of the dry pump for a fixed time period so as to purge a proportion of contaminant particulate matter present until a predefined temperature is reached or a predefined time limit has passed.

The carrier medium may be selected from but is not strictly limited to a floppy disk, a CD, a mini-disc or digital tape.

In one preferred option, the pulsed shut down method is performed at intervals corresponding to regular drops in the internal temperature of the pump apparatus. A suggested temperature drop interval is 10 degrees though this is not essential. The interval may equally be 2 degrees, 30 degrees or anything in between. Appropriate temperature intervals may be selected based on the cooling conditions, the amount of time available for the pulsed shut down process and other factors. Alternatively less regular temperature intervals may be pre-selected. For example a number of small intervals (eg 2 degrees) may be selected for the early part of the cooling period and increasingly larger intervals as the apparatus approaches the predefined "cool" temperature.

The fixed time period of the pulse is again variable and will desirably be selected based on cooling conditions or other practical factors. A fixed time period of between 15 and 45 seconds is suggested, and about 30 seconds considered practical. The fixed time period may be the same for each preselected temperature interval, or may be different. For example, the period may be of relatively longer duration at lower temperatures.

The duration of the pulse may be dictated by the apparatus reaching a predefined "cool" temperature, such as the usual room temperature. Alternatively, the method may be performed for a fixed time period irrespective of the cooling time. In the latter case a duration of about 2 hours is suggested, but not essential.

At the end of each fixed time period of operation of the pump mechanism a separate inlet purge function may be effected by the controller.

In some embodiments, the controller may be configured to cease the pulsed shutdown method when the first of a predetermined temperature or a predefined time limit has been reached.

The dry pump apparatus may be of any known form but one preferred form is a dry pump which includes a claw type rotor. Dry pumps of this form are known in the prior art. Briefly, they include a pair of shafts each carrying a pair of claw shaped rotors which rotate in opposite directions to trap and compress gas flowing along the axis of the shafts between each claw pair. During each complete rotation of the shafts, first the inlet port of each claw pair is exposed then both the inlet and outlet are isolated, finally the outlet is exposed allowing trapped gas to be expelled. In these arrangements, the controller controls the rotation of the shafts.

Since many existing dry pump apparatus include a controller which runs software for operating the pump, the invention can conveniently be implemented by uploading the computer program of the invention to the existing controller. Thus the control can be configured on shutdown automatically to perform the pulsed shut down method of the invention.

BRIEF DESCRIPTION OF THE DRAWINGS

For the purposes of exemplification, some embodiments of the invention will now be described with reference to the following Figures in which.

DETAILED DESCRIPTION OF THE INVENTION

Figure 1:
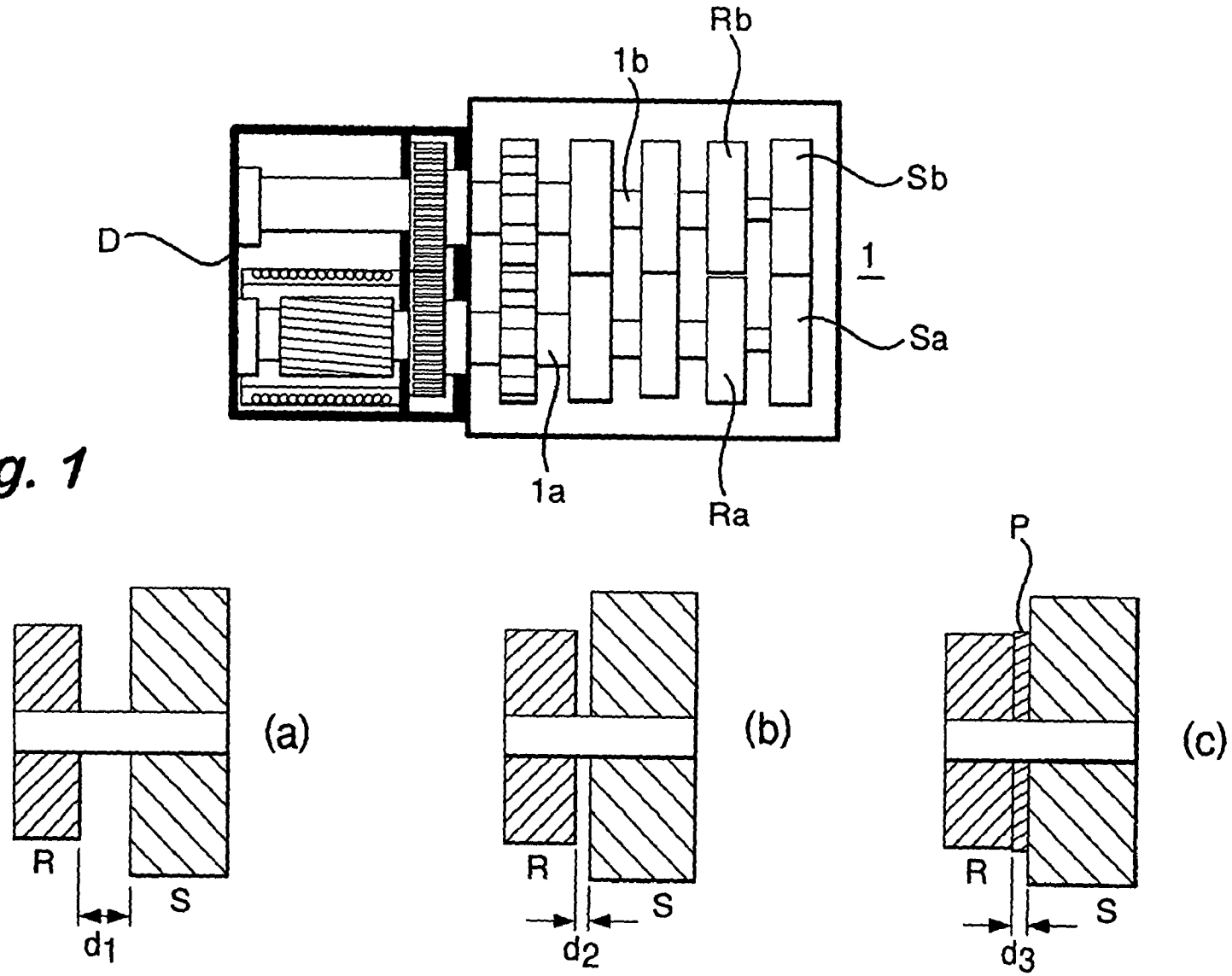
FIG. 1 illustrates the problem of particulate contamination addressed by the present invention

FIG. 1 shows schematically the pumping mechanism of a dry pump apparatus 1 having a drive unit D driving a pair of shafts 1*a*, 1*b* each carrying a stator Sa, Sb and a rotor Ra, Rb. FIGS. 1(*a*), 1(*b*) and 1(*c*) show the relationship between a rotor R and a stator S of the pumping mechanism. FIG. 1(*a*) illustrates the arrangement between the rotor R and stator S at normal running temperature of the pump. The running clearance between the stator S and rotor R is shown as $d_1$. As shown in FIG. 1(*b*) as the apparatus cools, the running clearance $d_2$ is reduced due to contraction of the shaft carrying the stator S and rotor R. As shown in FIG. 1(*c*), powder P which may have accumulated on the surface of the stator S, can become compacted in the reduced clearance between the stator S and rotor R. This compaction results in a frictional force to be overcome by the rotor R if it is to rotate on restart of the apparatus. If sufficient torque is not provided to the rotor R to overcome this frictional force, then start up failure occurs.

Figure 2:
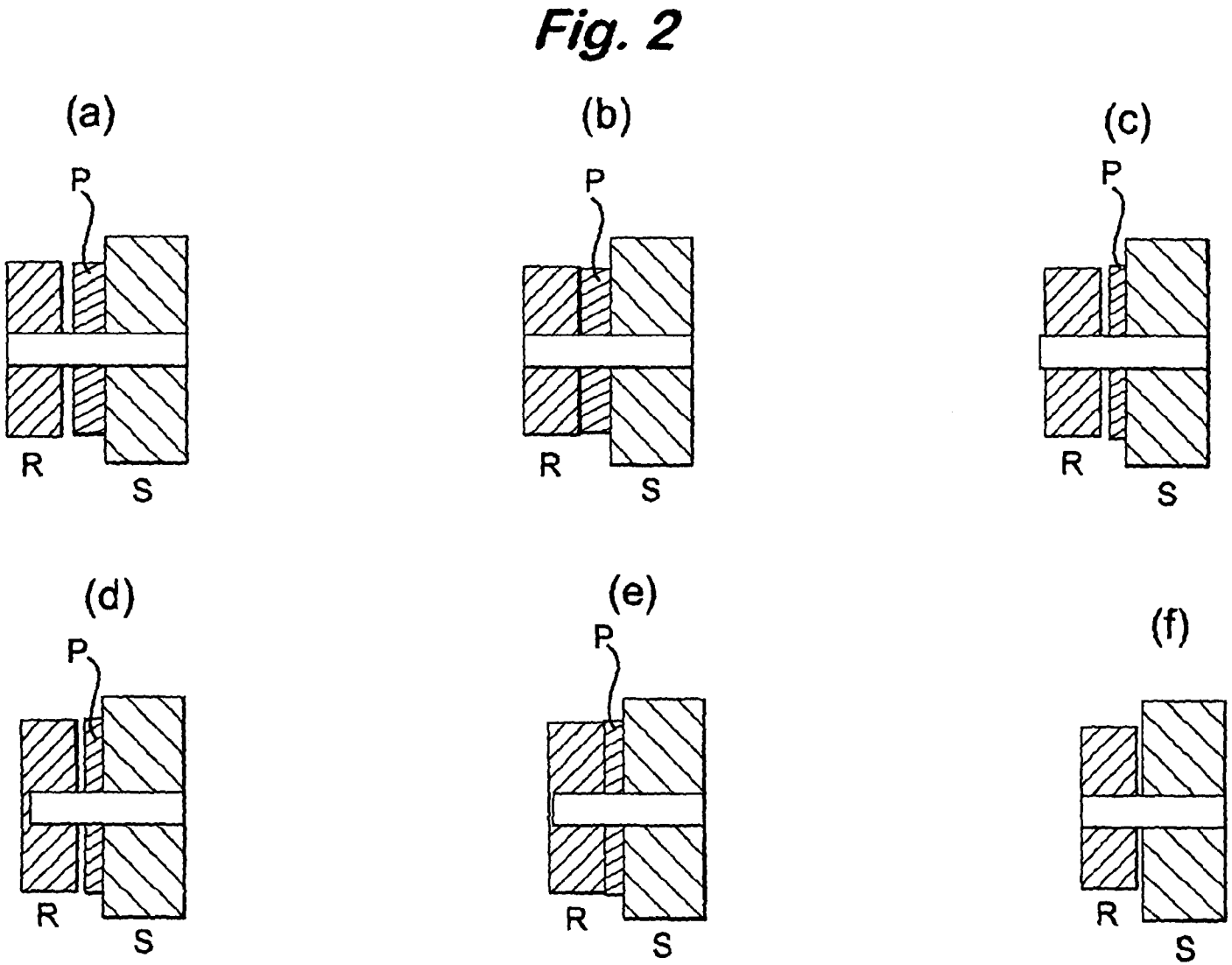
FIG. 2 illustrates how the present invention affects the process illustrated in FIG. 1

FIG. 2 shows in sequential order (Figures (a) to (f)) a stator S and rotor R cooling from running temperature (FIG. 2(*a*)) to gradually cooler temperatures (FIGS. 2(*b*)-2(*f*)). In each of FIGS. 2(*a*) to 2(*e*), it can be seen that there is a layer of settled powder P settled on the surface of the stator S. It will also be noted that the clearance between the stator S and rotor R gradually decrease as the temperature of the apparatus falls. Between FIGS. 2(*b*) and 2(*c*), 2(*c*) and 2(*d*) and 2(*e*) and 2(*f*), the pump is briefly activated and a proportion of the powder P is evacuated. Thus when the final cooling temperature is reached (FIG. 2(*f*)) the quantity of powder is minimal and insufficient to cause any great counter force against the torque of the rotor on restart. Thus the occurrence of start-up failure on restart is reduced.

Figure 3:
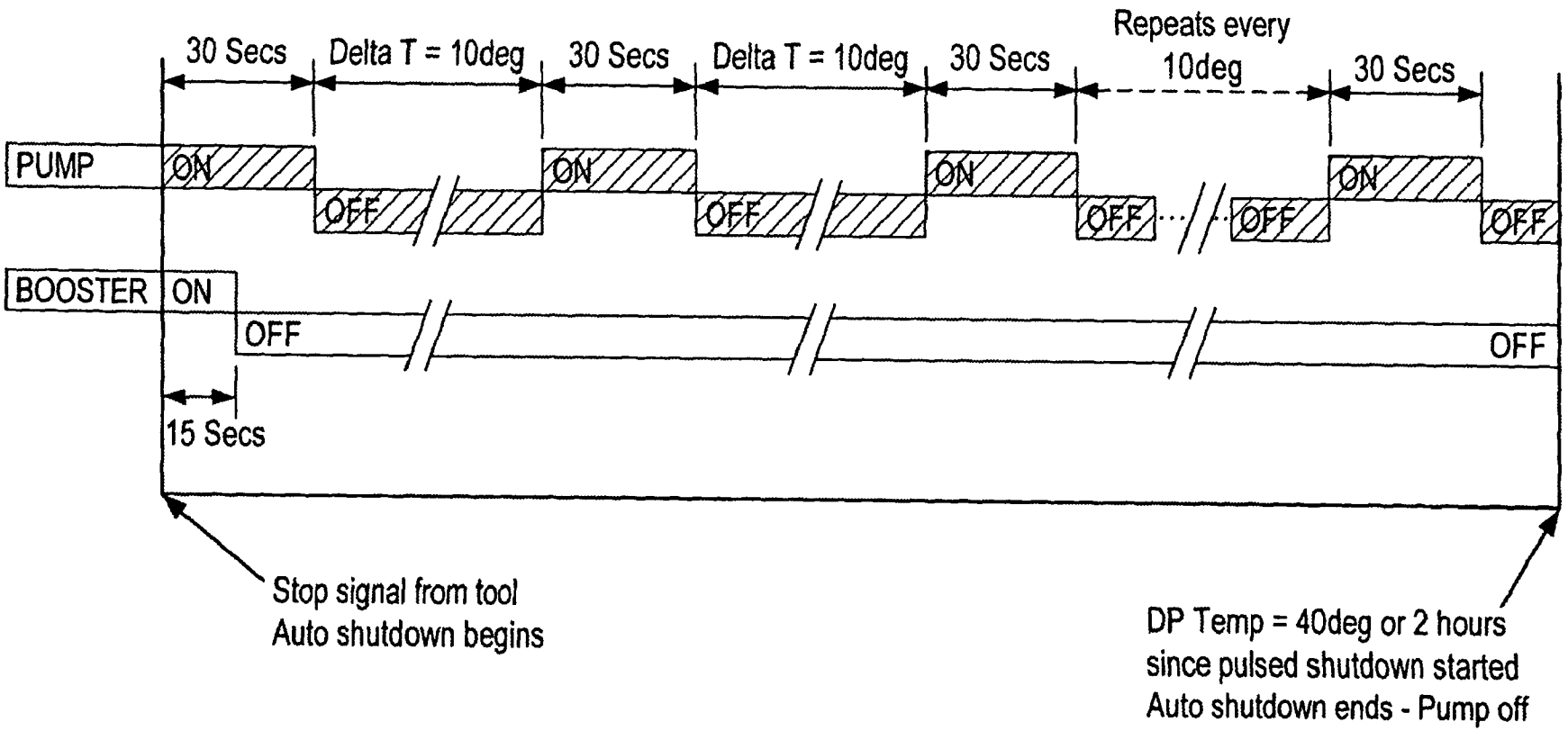
FIG. 3 illustrates the method of the invention in a time line format

FIG. 3 shows a time line of the pulsed shut down method of the invention. As can be seen, in tandem with the pulse sequence shown in the top line, a booster associated with the pump may be configured to run for a brief period after initial shutdown to aid in removal of any powderous contaminant within the pump mechanism to reduce the initial quantity which may settle on the stator while the pumping mechanism is inactive. As can be seen form the top line of the figure, after shutdown, the pump remains active for around 30 seconds and then is dormant for a period (Delta T=10 deg) while the internal temperature of the mechanism, monitored by the controller falls to 10 degrees (centigrade) below the normal operating temperature. When the period is complete, the pump is activated for 30 seconds then again held dormant until a further fall of 10 degrees in the monitored temperature. While in the exemplary embodiment the fixed time period for pump activation is 30 seconds, that time period may be in the range of from 15 to 45 seconds inclusive. The time period may be the same for each cycle, or may be different for each cycle. At the end of each fixed time period of operation of the pump mechanism, a separate inlet purge function may be effected by the controller. The cycle is repeated until either the monitored temperature is 40° C., or the time elapsed since the start of the sequence is two hours.

Figure 4:
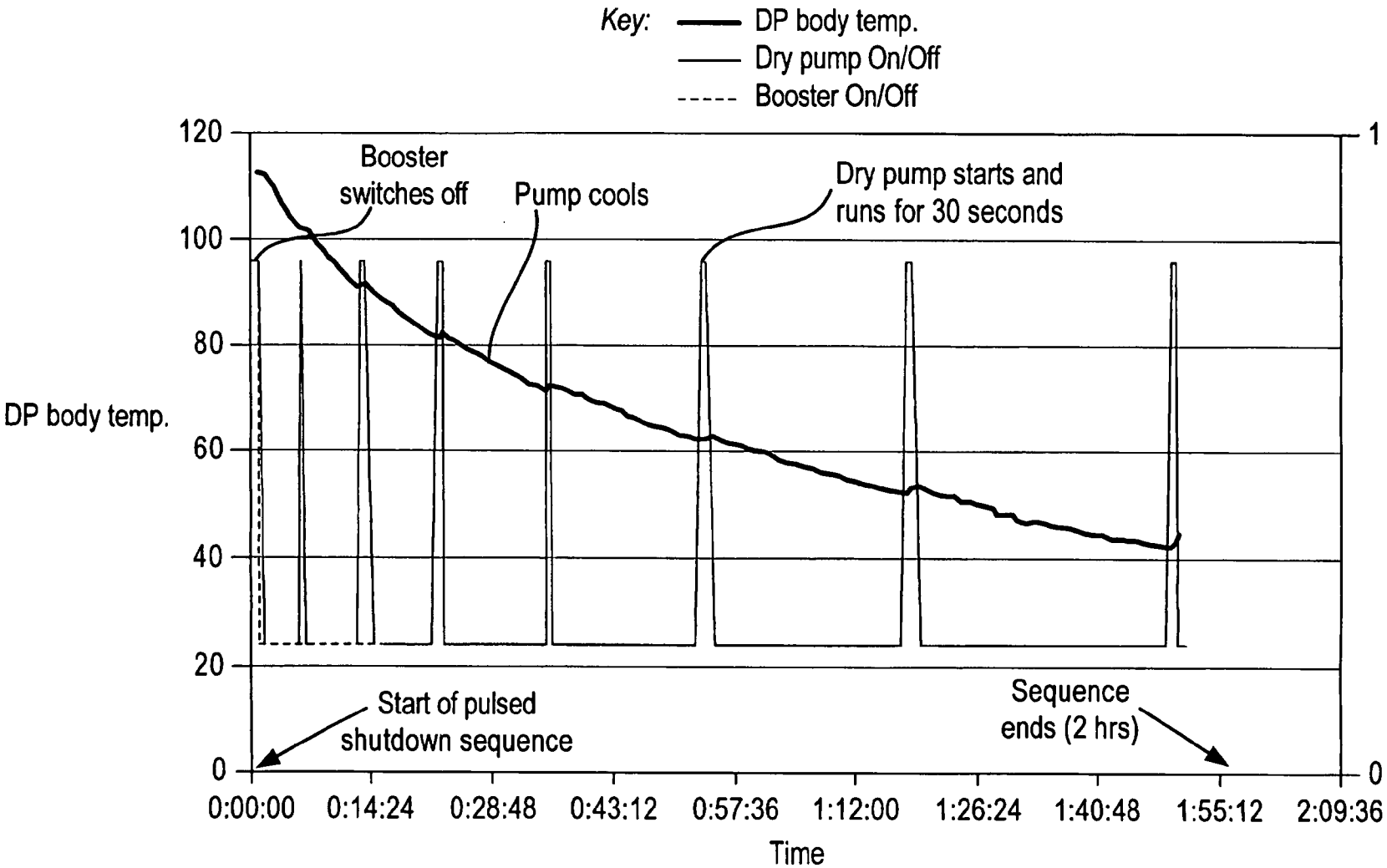
FIG. 4 illustrates the method of the invention in graph form.

FIG. 4 illustrates the method of FIG. 3 in graphical form. The vertical axis corresponds to the monitored temperature of the pumping mechanism, the horizontal axis corresponds to the passage of time. The thick, black curved line shows the monitored temperature gradually falling. The thinner, pulsed line shows active and dormant periods of the pumping mechanism during the cooling process.

Figure 5:
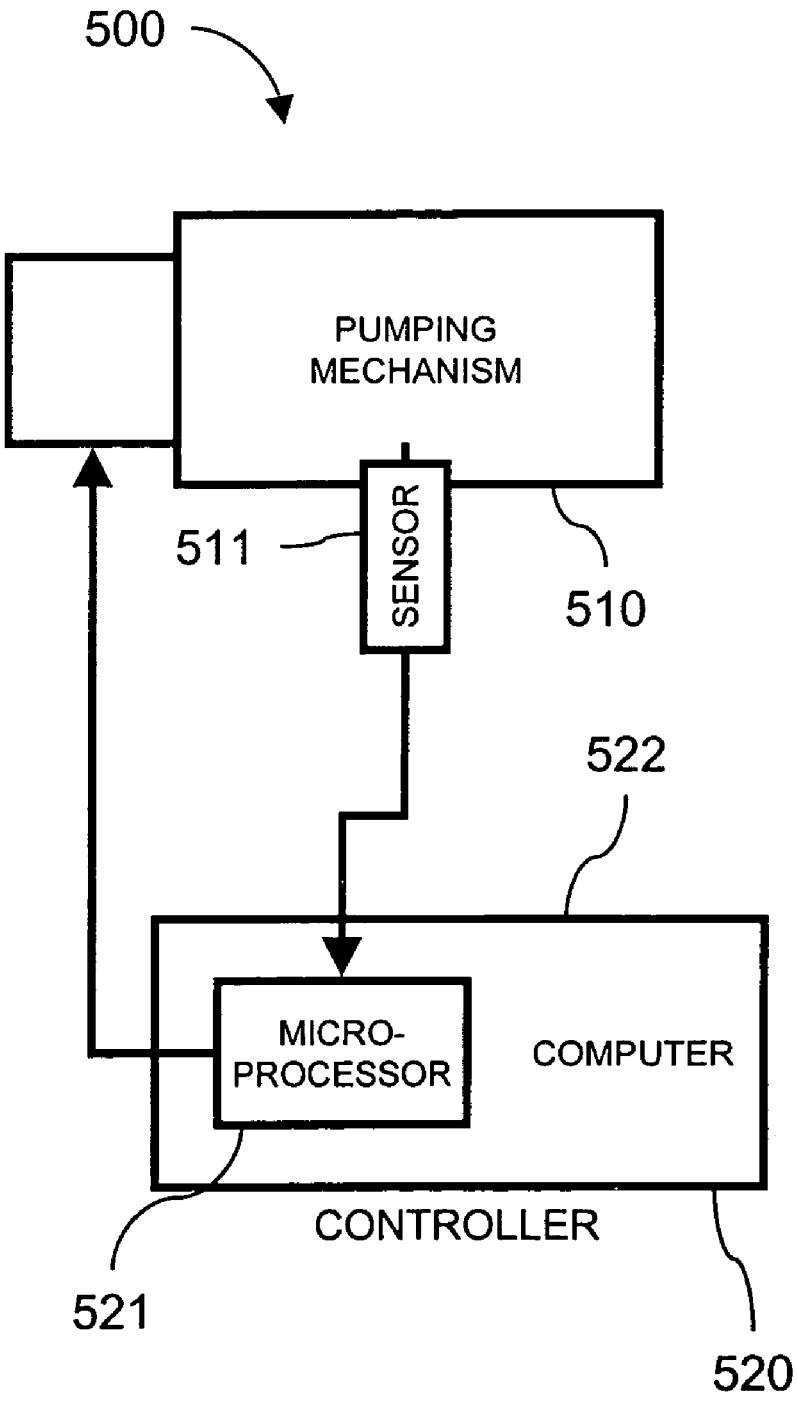
FIG. 5 illustrates a system in block diagram form according to one embodiment of the invention.

A system 500 according to one embodiment of the invention is shown in FIG. 5. The system 500 includes a pumping mechanism 510. The pumping mechanism may, for example, be a non-contacting, self-valving dry pump such as those used in semiconductor manufacture. In one embodiment, the pumping mechanism 510 is a claw type dry pump.

A temperature sensor 511 senses the operating temperature of the pumping mechanism 510. The sensor measures drops in the internal temperature of the pumping apparatus.

A controller 520 controls the operation of the pumping mechanism 510. The controller 520 may comprise a microprocessor 521 embodied in a computer 522. The controller 520 monitors the internal temperature of the pumping mechanism 510 by means of the temperature sensor 511.

The controller 520 further is configured to carry out an automated shut-down sequence of the pumping mechanism 510 by initiating and ceasing operation of the pumping mechanism according to a sequence and method. The controller may be configured by installing a computer program carried by a computer readable carrier medium such as a floppy disk, a CD, a mini-disc or a digital tape.

Figure 6:
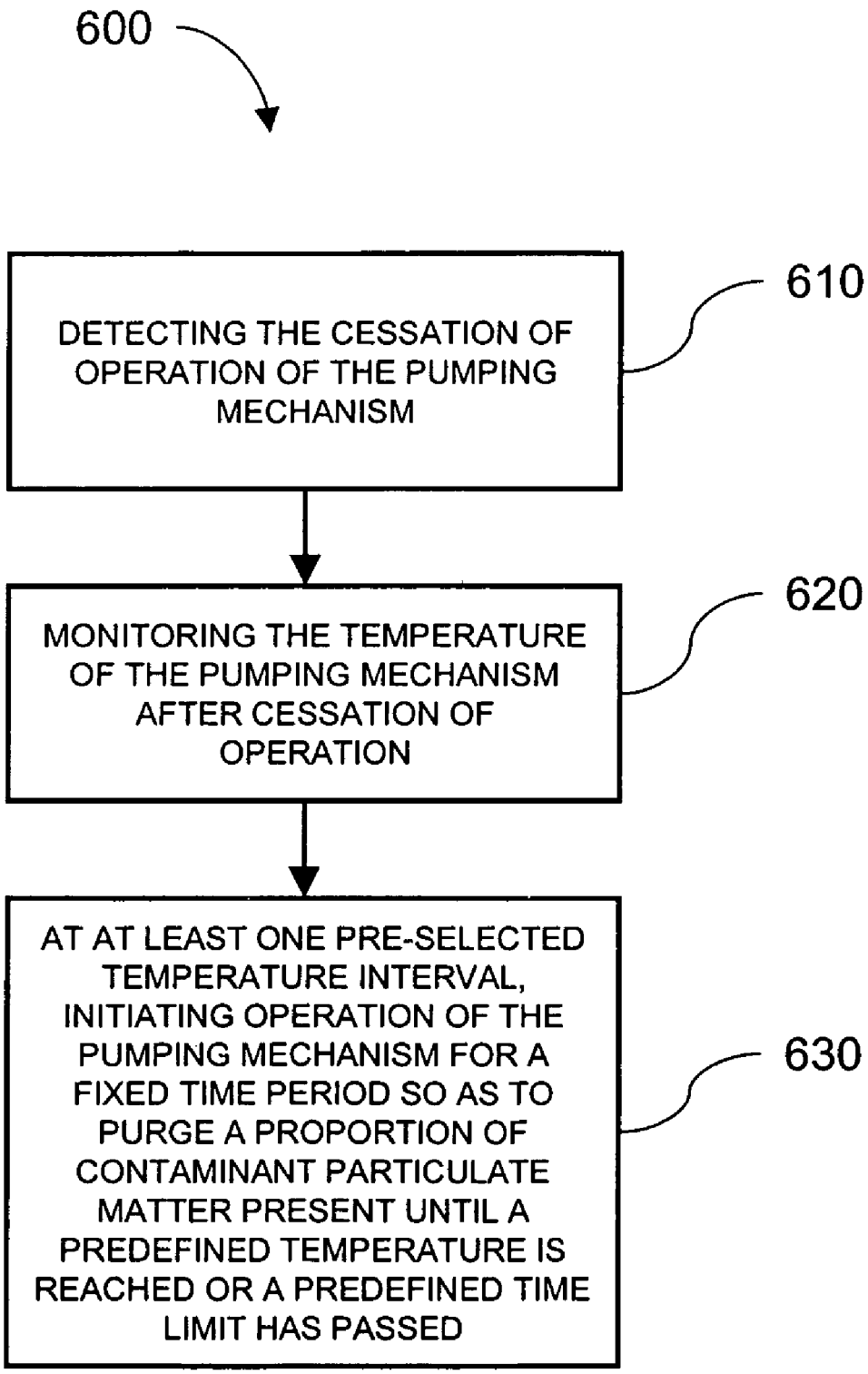
FIG. 6 illustrates a flow chart showing a method in accordance with one embodiment of the invention.

For example, the controller 520 may be configured to carry out an automated shutdown sequence according to the series of steps 600 shown in FIG. 6. In that sequence, the controller first detects (step 610) the cessation of operation of the pumping mechanism. The controller then monitors (step 620) the temperature of the pumping mechanism after cessation of operation. The temperature is monitored by means of the temperature sensor 511 (FIG. 5).

Returning to FIG. 6, at at least one pre-selected temperature interval, the controller initiates (step 630) operation of the pumping mechanism for a fixed time period so as to purge a proportion of contaminant particulate matter present until a predefined temperature is reached or a predefined time limit has passed.

It is to be understood that the foregoing represents just a few embodiments of the invention, others of which will no doubt occur to the skilled addressee without departing from the true scope of the invention as defined by the claims appended hereto.

The invention claimed is:

1. A dry pump apparatus comprising;

a pumping mechanism, a controller for controlling the operation of the pumping mechanism, and a sensor for sensing the operating temperature of the pumping mechanism wherein the controller is configured to carry out an automated shutdown sequence involving the following steps;

a) ceasing operation of the pumping mechanism b) monitoring the temperature of the pumping mechanism by means of the temperature sensor c) at at least one pre-selected temperature interval, initiating operation of the pumping mechanism for a fixed time period so as to purge a proportion of contaminant particulate matter present until a predefined temperature is reached or a predefined time limit has passed.

2. A dry pump apparatus as claimed in claim 1 wherein the controller comprises a microprocessor.

3. A dry pump apparatus as claimed in claim 2 wherein the microprocessor is embodied in a computer.

4. A dry pump as claimed in claim 3 wherein the computer has installed thereon computer software which causes it to perform the method steps a) to c).

5. A dry pump apparatus as claimed in claim 1 wherein the pumping mechanism includes a claw type rotor arrangement.

6. A method for reducing the incidence of restart failure in a dry pump comprising the steps of;

a) detecting the cessation of operation of the pumping mechanism b) monitoring the temperature of the pumping mechanism after cessation of operation c) at at least one pre-selected temperature interval, initiating operation of the pumping mechanism for a fixed time period so as to purge a proportion of contaminant particulate matter present until a predefined temperature is reached or a predefined time limit has passed.

7. A method as claimed in claim 6 wherein step c) is performed at preselected temperature intervals corresponding to regular drops in the monitored temperature of the pumping mechanism.

8. A method as claimed in claim 7 wherein the regular drop interval is 10° C.

9. A method as claimed in claim 6 wherein the fixed time period is between 15 and 45 seconds inclusive.

10. A method as claimed in claim 6 wherein the fixed time period is the same for each pre-selected temperature interval.

11. A method as claimed in claim 10 wherein the fixed time period is 30 seconds.

12. A method as claimed in claim 6 wherein the fixed time period is different for each pre-selected temperature interval.

13. A method as claimed in claim 6 wherein the method is performed for a predefined time limit.

14. A method as claimed in claim 13 wherein the predefined time limit is 2 hours from cessation of operation.

15. A method for reducing the incidence of restart failure in a dry pump comprising the steps of:

a) detecting the cessation of operation of the pumping mechanism;

b) monitoring the temperature of the pumping mechanism after cessation of operation;

c) at at least one pre-selected temperature interval, initiating operation of the pumping mechanism for a fixed time period so as to purge a proportion of contaminant particulate matter present until a predefined temperature is reached or a predefined time limit has passed wherein at the end of each fixed time period of operation of the pump mechanism a separate inlet purge function is effected by the controller.

16. A method as claimed in claim 6 wherein the method is ceased when the first of a predetermined temperature or a predefined time limit has been reached.

17. A computer readable carrier medium which carries instructions adapted to be executed by a processor, the instructions which, when executed, define a series of steps to carry out an automated shutdown sequence of a dry pumping mechanism, comprising:

a) detecting the cessation of operation of the pumping mechanism;

b) monitoring the temperature of the pumping mechanism after cessation of operation; and c) at at least one pre-selected temperature interval, initiating operation of the pumping mechanism for a fixed time period so as to purge a proportion of contaminant particulate matter present until a predefined temperature is reached or a predefined time limit has passed.

18. The computer readable carrier medium as claimed in claim 17 wherein the medium is selected from; a floppy disk, a CD, a mini-disc or digital tape.

19. The computer readable carrier medium as claimed in claim 17 wherein at the end of each fixed time period of operation of the pump mechanism, a separate inlet purge function is effected by the controller.

20. The computer readable carrier medium as claimed in claim 17 wherein step c) is performed at pre-selected temperature intervals corresponding to regular drops in the monitored temperature of the pumping mechanism.

* * * * *